US009399874B2

(12) United States Patent
Spielman

(10) Patent No.: US 9,399,874 B2
(45) Date of Patent: Jul. 26, 2016

(54) TREAD CAP AND METHODS AND PROCESSES RELATED THERETO

(76) Inventor: Peter Spielman, Keswick, VA (US)

( * ) Notice: Subject to any disclaimer, the term of this patent is extended or adjusted under 35 U.S.C. 154(b) by 0 days.

(21) Appl. No.: 13/981,578

(22) PCT Filed: Jan. 24, 2012

(86) PCT No.: PCT/US2012/022428

§ 371 (c)(1),
(2), (4) Date: Oct. 4, 2013

(87) PCT Pub. No.: WO2012/103137

PCT Pub. Date: Aug. 2, 2012

(65) Prior Publication Data

US 2014/0026500 A1 Jan. 30, 2014

Related U.S. Application Data

(60) Provisional application No. 61/435,624, filed on Jan. 24, 2011.

(51) Int. Cl.

| | |
|---|---|
| ***E04F 11/104*** | (2006.01) |
| ***E04F 11/16*** | (2006.01) |
| ***E04F 11/17*** | (2006.01) |

(52) U.S. Cl.
CPC ..... *E04F 11/166* (2013.01); *E04F 11/175* (2013.01)

(58) Field of Classification Search
CPC ... E04F 11/166; E04F 11/104; E04F 11/1042; E04F 11/1043; E04F 11/1045; E04F 11/108; E04F 11/16; E04F 11/17; E04F 11/175
USPC ..... 52/179, 182, 741.2; 144/346, 354
See application file for complete search history.

(56) References Cited

U.S. PATENT DOCUMENTS

| | | | | |
|---|---|---|---|---|
| 4,322,927 | A * | 4/1982 | Scott | 52/188 |
| 6,067,758 | A * | 5/2000 | Zenkner | 52/182 |
| 2009/0277104 | A1 * | 11/2009 | McCool | 52/179 |

* cited by examiner

*Primary Examiner* — Patrick Maestri
(74) *Attorney, Agent, or Firm* — Matthew A. Pequignot; Pequignot + Myers LLC

(57) ABSTRACT

Capping structures for covering existing stair treads to provide a bull nose configuration. Additionally, unique processes and/or methods for manufacturing or making such capping structures.

14 Claims, 6 Drawing Sheets

TREAD CAP AND METHODS AND PROCESSES RELATED THERETO

RELATED APPLICATION DATA

This application is the national stage entry of International Appl. No. PCT/US2012/022428, filed Jan. 24, 2012, which claims priority to U.S. patent application Ser. No. 61/435,624, filed Jan. 24, 2011, entitled TREAD CAP. All claims of priority to these applications are hereby made and these applications are hereby incorporated in their entireties by reference.

FIELD OF THE INVENTION

This invention relates to capping structures for covering existing stair treads to provide a bull nose configuration and/or a unique process and/or method for manufacturing or making such capping structures.

BACKGROUND OF THE INVENTION

In certain types of house or other building type renovations, there remain various drawbacks and difficulties in the art related to options available for renovating stair cases—specifically stair treads. For example, when renovating an already carpeted house having stairs with laminate flooring, the carpet is removed from the floor and stairs to expose the floor and stair surfaces on which laminate flooring may be installed. In prior art techniques, in order to install the laminate on the stairs, existing bull nosing on the stair treads would first need to be removed (e.g., with a saw). This requires substantial labor and skill so that, for example, the removal of the bull nose leaves "square" surfaces on the remaining tread and so that the structural integrity of the tread is not compromised.

After removal of the existing bull nose, two or more pieces of laminate floor would be installed on the tread and then a piece of conventional laminate bull nosing would be added to recreate the bull nose of the tread. Such a renovation process requires considerable skill and effort, some of which might be beyond the skill level of typical do-it-yourself home renovators, for example.

In view of the above, it is apparent that there exists a need in the art for apparatus or methods or processes which address, overcome, mitigate, and/or solve one or more of the above problems and/or drawbacks and/or inefficiencies in the art. It is a purpose of this invention to fulfill this and/or other needs in the art which will become more apparent to the skilled artisan once given the following disclosure.

SUMMARY OF THE INVENTION

Generally speaking, this invention addresses the above-described needs in the art, as well as others not specifically described, by providing a unique capping structure for covering an existing stair tread and a novel method and/or process of manufacturing or making such a capping structure.

In at least one non-limiting example embodiment, the unique structure and/or method/process result in a manner of capping or covering an existing tread such that reduced labor and skill are required as compared to the prior art. For example, the unique capping structure provided by this invention allows an existing stair tread to be capped without requiring that a bull nose on the existing tread be cut off prior to the installation of the capping structure. Cutting off the bull nose, in prior art techniques, requires additional labor and precision in execution to obtain satisfactory results. Such prior art techniques and/or methods are not well suited when employing less skilled labor or for "do-it-yourself" renovation projects.

At least one embodiment of the invention is useful in a renovation scenario where, in a prior carpeted house having stairs, carpet is removed from the floor and stairs so that a laminate floor can be installed both on the main room floor(s) as well as on the stair treads. In prior art techniques, in order to install the laminate on the stairs, first one would have to cut off the existing bull nosing. Afterwards, a laborer would have to glue down two or more pieces of laminate flooring on the existing tread as well as a piece of conventional laminate bull nosing to make the bull nose of the tread. Also, it is possible that the stairway is wider than the laminate floor pieces in which case a laborer would have to assemble several laminate pieces together. Such a renovation process requires considerable skill and effort. In at least one embodiment of the present invention, however, one can simply cut the provided unique (preferably single piece) capping structure to length and glue it over the existing stairway and put a new riser board up if you choose. Preferably, the capping structure is thin enough so that the rise from the floor to the first tread is kept nearly the same so that the tread meets code and the laborer or homeowner only has to glue the cap over the existing tread. This technique is advantageous because many stairs are soft pine or particle board under the carpet and cannot be left bare.

In at least one non-limiting embodiment of the present invention, therein is provided: a method of producing a capping structure for covering a pre-existing stair structure having a bull nose, the method comprising: providing a generally rectangular, generally planar tread element, and machining a groove in a surface of the tread element proximal a longitudinal edge thereof, the groove being machined to extend substantially the entire length of one side of the tread element; providing a generally rectangular cap precursor element which is sized in at least one dimension to have a thickness which is approximately equal to the width of the groove and which is sized in at least one other dimension to have a length approximately equal to the length of the groove; gluing the cap precursor element to the groove so that the width and length of the groove and the cap precursor elements are substantially spatially aligned; machining joined outward facing surfaces of the tread element and the cap precursor element to form a convex, bull nose shaped configuration; affixing a wear resistant, decorative thin laminate to an upper surface of the tread element and to the convex, bull nose shaped configuration; and machining a surface of the cap precursor element located on a side of the cap precursor element which is substantially opposite the convex, bull nose shaped configuration to have a concave radius, such radius being suitably sized to form a recessed portion in the cap precursor element which is configured to mate with an existing bull nose of a stair tread.

In some embodiments, the cap precursor element is formed by cutting a strip configuration from a suitably thick sheet of manufactured wood; and a cut surface of the cap precursor element is the surface which is glued to the groove of the tread element. In the same or other embodiments, the cap precursor element and the tread element are each comprised of manufactured wood selected from the group consisting of: engineered wood, hardboard, low-density fiberboard, medium-density fiberboard, high-density fiberboard, particle board, pressed wood, and oriented strand board. In the same or other embodiments, the cap precursor element and the tread element are each comprised of moisture resistant manufactured wood. In the same or other embodiments, the tread element has a starting thickness of approximately 6.5-14 mm and the groove which is machined into the tread element is approximately 3-6 mm in depth and 18-30 mm in width. In the same or other embodiments, the cap precursor element is configured to be approximately 18-30 mm in width and approximately 30-50 mm in height.

It is, of course, recognized that any of the above method or process embodiments produce unique apparatus having the resulting defined configurations and/or dimensions. By way of non-limiting, broad example, however, at least one apparatus of the invention is provided in which the apparatus comprises: a capping structure for covering a pre-existing stair structure having a bull nose, the apparatus comprising: a generally rectangular, generally planar tread element machined to have a groove in a surface of the tread element proximal a longitudinal edge thereof, the groove being machined to extend substantially the entire length of one side of the tread element; a generally rectangular cap precursor element which is sized in at least one dimension to have a thickness which is approximately equal to the width of the groove and which is sized in at least one other dimension to have a length approximately equal to the length of the groove, the cap precursor element being glued to the groove so that the width and length of the groove and the cap precursor elements are substantially spatially aligned; wherein joined outward facing surfaces of the tread element and the cap precursor element are machined to form a convex, bull nose shaped configuration; wherein a wear resistant, decorative thin laminate is affixed to an upper surface of the tread element and to the convex, bull nose shaped configuration; and wherein a surface of the cap precursor element located on a side of the cap precursor element which is substantially opposite the convex, bull nose shaped configuration is machined to have a concave radius, such radius being suitably sized to form a recessed portion in the cap precursor element which is configured to mate with an existing bull nose of a stair tread.

Although numerous glue and/or adhesive types may be used in conjunction with the present invention, one particularly advantageous type of glue which may be used, and is used in certain embodiments, is polyurethane, cross-linking hot-melt glue.

The term "rectangle" is used herein according to its normal definition, and includes within its scope, for example, a structure having equal length sides, such as a square. Terms of approximation such as "generally" are also used according to their normal dictionary and court recognized definitions. The term "substantially" is also used as a term denoting approximation and is similar in scope to the term "mostly".

Certain specific examples of the invention are now described below with respect to certain non-limiting embodiments thereof as illustrated in the following drawings wherein:

DETAILED DESCRIPTION OF CERTAIN NON-LIMITING EMBODIMENTS

For a more complete understanding of the present invention and advantages thereof, reference is now made to the following description of various illustrative and non-limiting embodiments thereof, taken in conjunction with the accompanying drawings in which like reference numbers indicate like features.

Non-Limiting Example Process or Method

Figure 1:
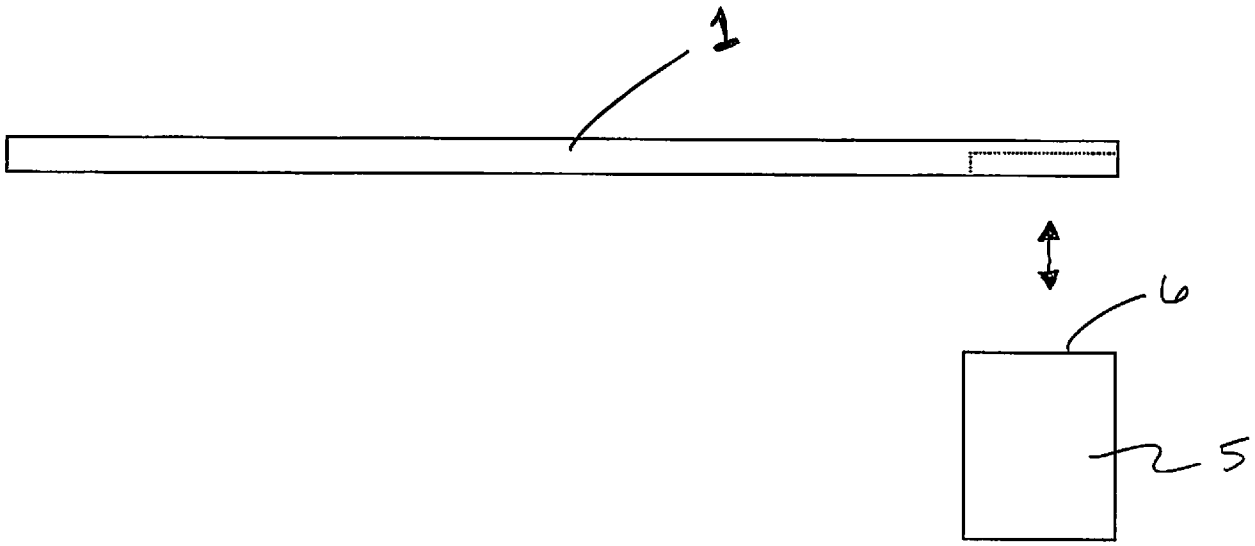
FIG. 1 illustrates example starting steps and/or materials for producing apparatus according to at least one embodiment of the subject invention.

Referring initially to FIG. 1, therein is illustrated an example of starting materials provided for use in the first step for producing or manufacturing a capping apparatus according to at least one embodiment of the subject invention. As illustrated in the figure, a tread element 1 is provided which is intended to replace the existing tread surface of a stair being renovated. Preferably—but not necessarily—tread element 1 is made of high density fiberboard ("HDF") having a thickness selected from between 7 mm and 10 mm and a width selected at approximately 300 mm +/−25 mm (other useful thicknesses and dimensions, for this structure as well as others described below, are listed in the Summary of Invention section above). A cap precursor element 5 is also provided which is formed from a moisture resistant fiberboard ("MRF") preferably selected to be between 22 mm and 25 mm wide and approximately 40 mm in height (in certain preferred embodiments, element 5 is obtained by cutting a strip from a 22-25 mm thick sheet of fiberboard, so that at least one cut surface 6 is exposed).

Figure 2:
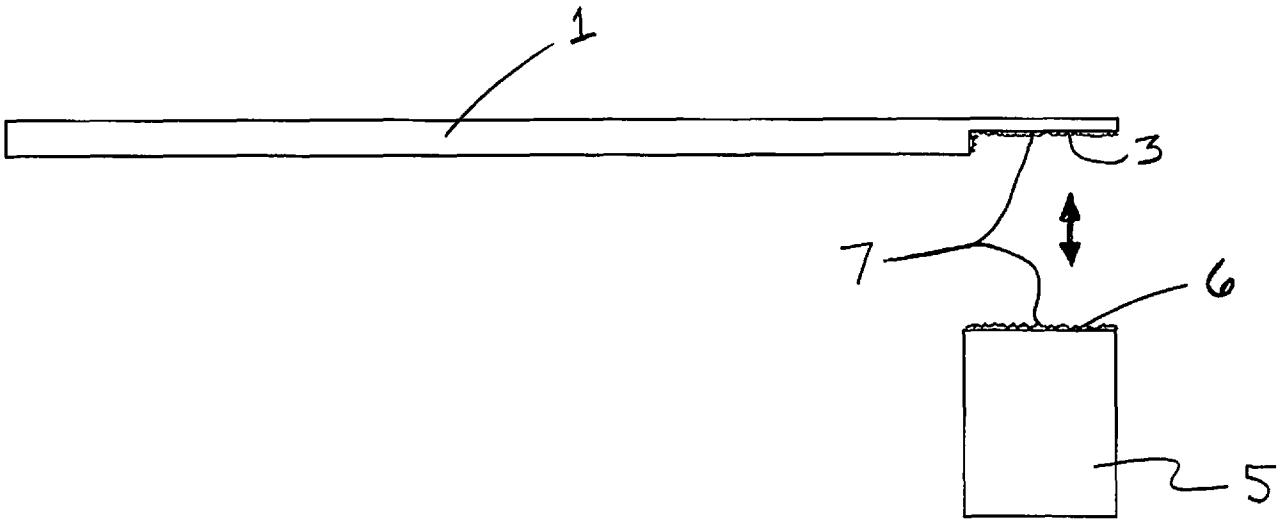
FIG. 2 illustrates the materials depicted in FIG. 1, with a groove machined into the illustrated tread element.
Figure 3:
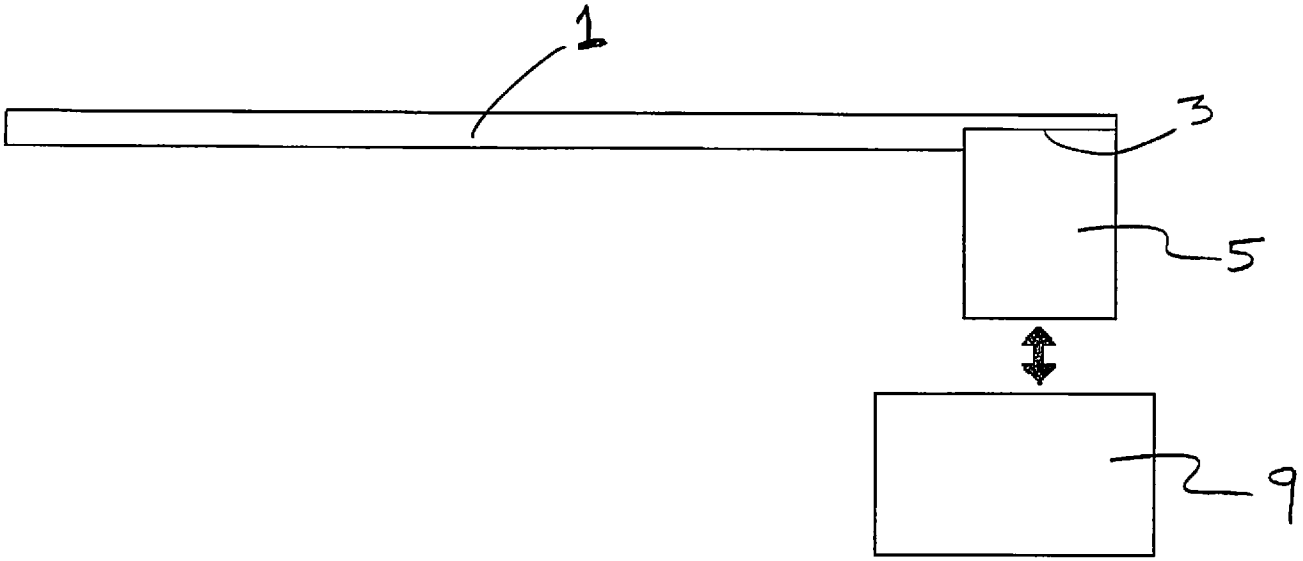
FIG. 3 illustrates the materials depicted in FIG. 2, with the cap precursor element being glued and clamped to the groove of the tread element.

Turning now to FIG. 2, such figure illustrates tread element 1 with a groove 3 having been machined into the element. Preferably, in this embodiment, the groove is machined to be approximately 4 mm in depth and to be approximately 22-25 mm in width, to substantially or completely match the width dimension of cap precursor element 5. Also as depicted, adhesive or glue 7 is used on one or both of groove 3 and element 5 in order to bond elements 1 and 5 to each other such as depicted in FIG. 3 (a clamping block 9 may be used with a clamp, not shown, to secure element 5 to element 1 while the glue or adhesive dries). Preferably, the surface of cap precursor element 5 which is glued to tread element 1 is a cut edge surface, because the resulting bond has been found to be particularly durable and therefore useful given that the combination of elements is later twice machined. Alternatively, if the materials used to create elements 1 and 5 have grain, the grain of element 5 is preferably (but not necessarily) oriented, upon assembly, so as to be perpendicular to the grain of tread element 1. The glue is preferably a polyurethane hot-melt adhesive, however other glue and/or adhesive types may be used. Of course, tread element 1 is actually a sheet with a generally rectangular configuration, although not shown three-dimensionally in the drawings (only a cross-section is depicted therein). Element 5, similarly, has a length (not depicted) which generally matches the length of groove 3 machined into tread element 1. In this regard, groove 3 and cap precursor element 5 are preferably sized so that element 5 is generally aligned with and fills the entire space defined by groove 3 (e.g., preferably without extending beyond the dimensions of tread element 1).

Figure 4:
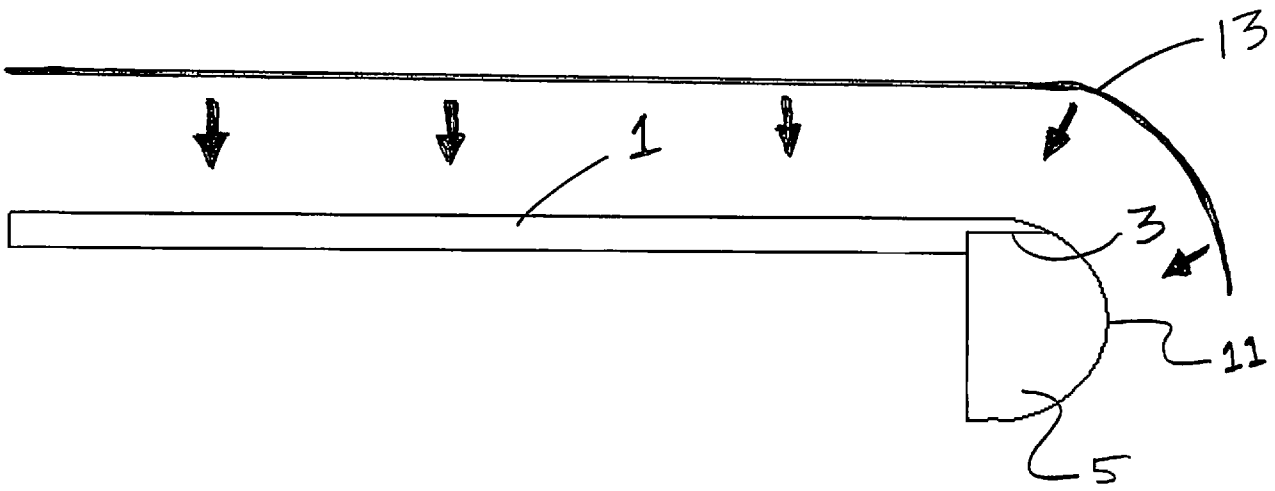
FIG. 4 illustrates the materials depicted in FIG. 3 with the joined elements having been machined to form a bull nose configuration, and a laminate sheet being applied to the tread element and bull nose configuration.
Figure 5:
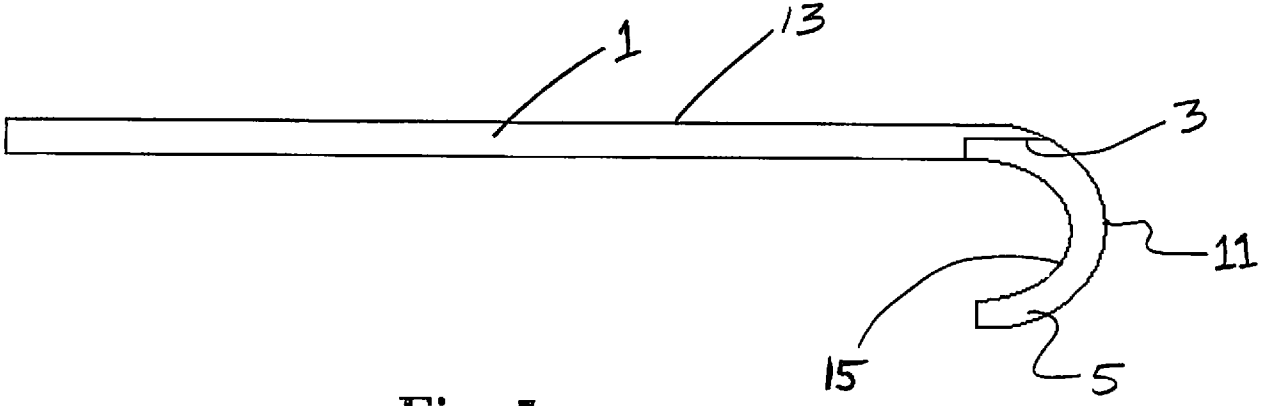
FIG. 5 illustrates the joined materials depicted in FIG. 4, with an inside surface of the cap precursor element having been machined to a selected radius to form a recess matable to an existing bull nose of a stair tread.

After bonding cap precursor element 5 to tread element 1, the resulting structure is machined or milled to form a bull nose configuration 11, such as depicted in FIG. 4. After the bull nose is machined (or milled), a laminate structure is applied and bonded to the upward facing major surface of tread element 1 as well as to the outer facing curved surface of bull nose 11 (e.g., using a profile wrapper). Such a laminate structure is preferably a laminate sheet 13, such as a wear resistant, decorative laminate of suitable thickness (taking into account the radius of curvature of the bull nose) and may be, for example, a thermosetting laminate or a continuous pressure laminate (other laminate types may, of course, be used). The laminate sheet 13 provides a number of benefits in certain embodiments, including structural strength, wear resistance, and/or decorative properties (e.g., the appearance of hard wood, bamboo, etc.).

Figure 6:
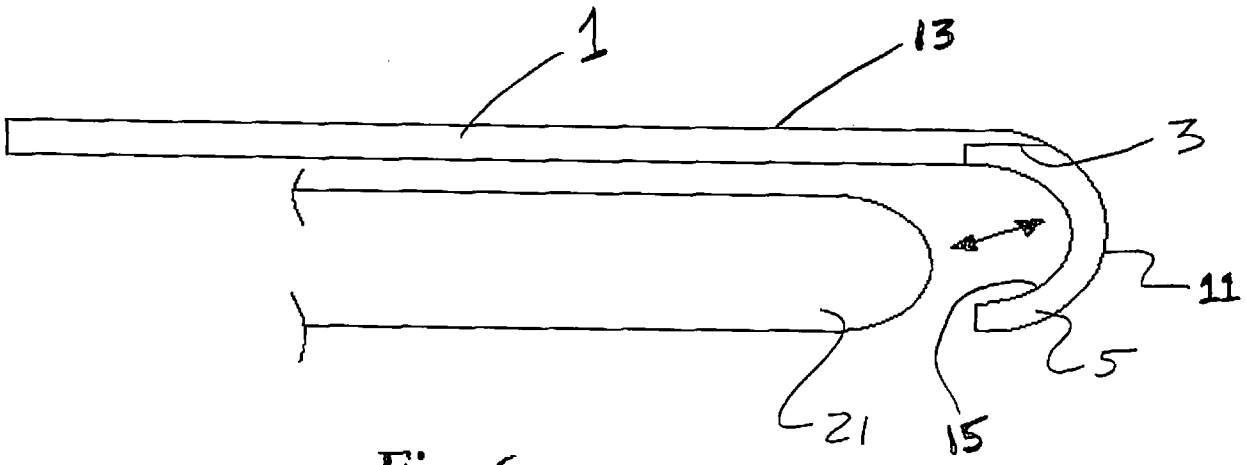
FIG. 6 illustrates an example capping structure according to one embodiment of the present invention being installed to an existing stair tread.

After the product is wrapped with laminate sheet 13, the product is then preferably taken to a CNC machining center where the inside of the bull nose (the surface of element 5 located on the opposite side of bull nose 11) is routed at a radius—for example of 14 mm—so as to form a recess or concave region in element 5 which is sized and configured to be physically matable to an existing bull nosed stair tread (e.g., see FIG. 6). In particular, the region which is routed preferably creates a recess 15 which is configured to encapsulate an entire existing stair tread bull nose without having to saw off the nose of the existing tread. This is advantageous because, in prior art methods of renovating stairs, the existing stair tread bull nose had to be cut off the tread to be covered with laminate or wood. Recognizing that 90% or more of stair treads in the United States are 1" thick, in certain preferred embodiments, a recess (such as recess 15) is routed to have a radius slightly bigger than 12.7 mm or ½". Importantly, routing recess 15 after applying laminate 13 in certain preferred embodiments prevents the product from being broken apart or otherwise damages during the manufacturing or production process.

FIG. 6 illustrates the product being installed on an existing stair tread 21, with the curvature of recess 15 generally matching the curvature of the bull nose of the existing stair tread. Attachment of the capping structure to tread 21 can be accomplished by one or a combination of means, including glue or adhesives, and/or via the use of mechanical fasteners such as nails or staples.

Once given the above disclosure, many other features, modifications, and improvements will become apparent to the skilled artisan. Such features, modifications, and improvements are therefore considered to be part of this invention, without limitation imposed by the example embodiments described herein. Moreover, any word, term, phrase, feature, example, embodiment, or part or combination thereof, as used to describe or exemplify embodiments herein, unless unequivocally set forth as expressly uniquely defined or otherwise unequivocally set forth as limiting, is not intended to impart a narrowing scope to the invention in contravention of the ordinary meaning of the claim terms by which the scope of the patent property rights shall otherwise be determined.

I claim:

1. A method of producing a capping structure for covering a pre-existing stair structure having a bull nose, the method comprising:

providing a generally rectangular, generally planar tread element, and machining a groove in a surface of said tread element proximal a longitudinal edge thereof, said groove being machined to extend substantially the entire length of one side of said tread element;

providing a generally rectangular cap precursor element which is sized in at least one dimension to have a thickness which is approximately equal to the width of said groove and which is sized in at least one other dimension to have a length approximately equal to the length of said groove;

gluing said cap precursor element to said groove so that the width and length of said groove and said cap precursor elements are substantially spatially aligned;

machining joined outward facing surfaces of said tread element and said cap precursor element to form a convex, bull nose shaped configuration;

affixing a wear resistant, decorative thin laminate sheet to an upper surface of said tread element and to said convex, bull nose shaped configuration; and machining a surface of said cap precursor element located on a side of said cap precursor element which is substantially opposite said convex, bull nose shaped configuration to have a concave radius, such radius being suitably sized to form a recessed portion in said cap precursor element which is configured to mate with an existing bull nose of a stair tread.

2. The method according to claim 1 wherein the cap precursor element is formed by cutting a strip configuration from a suitably thick sheet of manufactured wood; and wherein a cut surface of said cap precursor element is the surface which is glued to said groove of said tread element.

3. The method according to claim 2 wherein said cap precursor element and said tread element are each comprised of manufactured wood selected from the group consisting of:

engineered wood, hardboard, low-density fiberboard, medium-density fiberboard, high-density fiberboard, particle board, pressed wood, and oriented strand board.

4. The method according to claim 2 wherein said cap precursor element and said tread element are each comprised of moisture resistant manufactured wood.

5. The method according to claim 3 wherein said tread element has a starting thickness of approximately 6.5-14 mm and wherein said groove which is machined into said tread element is approximately 3-6 mm in depth and 18-30 mm in width.

6. The method according to claim 5 wherein said cap precursor element is configured to be approximately 18-30 mm in width and approximately 30-50 mm in height.

7. A capping apparatus for covering a pre-existing stair structure having a bull nose, said apparatus comprising:

a generally rectangular, generally planar tread element machined to have a groove in a surface of said tread element proximal a longitudinal edge thereof, said groove being machined to extend substantially the entire length of one side of said tread element;

a generally rectangular cap precursor element which is sized in at least one dimension to have a thickness which is approximately equal to the width of said groove and which is sized in at least one other dimension to have a length approximately equal to the length of said groove, said cap precursor element being glued to said groove so that the width and length of said groove and said cap precursor elements are substantially spatially aligned;

wherein joined outward facing surfaces of said tread element and said cap precursor element are machined to form a convex, bull nose shaped configuration;

wherein a wear resistant, decorative thin laminate sheet is affixed to an upper surface of said tread element and to said convex, bull nose shaped configuration; and wherein a surface of said cap precursor element located on a side of said cap precursor element which is substantially opposite said convex, bull nose shaped configuration is machined to have a concave radius, such radius being suitably sized to form a recessed portion in said cap precursor element which is configured to mate with an existing bull nose of a stair tread.

8. A capping apparatus according to claim 7 wherein said cap precursor element has at least one cut surface and is glued to said groove of said tread element at said at least one cut surface.

9. A capping apparatus according to claim 8 wherein said cap precursor element and said tread element are each comprised of manufactured wood selected from the group consisting of: engineered wood, hardboard, low-density fiberboard, medium-density fiberboard, high-density fiberboard, particle board, pressed wood, and oriented strand board.

10. A capping apparatus according to claim 8 wherein said cap precursor element and said tread element are each comprised of moisture resistant manufactured wood.

11. A capping apparatus according to claim 10 wherein said tread element has a thickness of approximately 6.5-14 mm and wherein said groove which is machined into said tread element is approximately 3-6 mm in depth and 18-30 mm in width.

12. A capping apparatus according to claim 11 wherein said cap precursor element is approximately 18-30 mm in width and approximately 30-50 mm in height.

13. A method according to claim 1 wherein said wear resistant, decorative thin laminate sheet is a laminate selected from the group consisting of: a thermosetting laminate and a continuous pressure laminate.

14. A capping apparatus according to claim 7 wherein said wear resistant, decorative thin laminate sheet is a laminate selected from the group consisting of: a thermosetting laminate and a continuous pressure laminate.

* * * * *